US005135464A

United States Patent [19]

Buchanan

[11] Patent Number: 5,135,464

[45] Date of Patent: Aug. 4, 1992

[54] METHOD FOR MANUFACTURING A CONTAINER

[75] Inventor: Jerry E. Buchanan, Alpharetta, Ga.

[73] Assignee: Jebco Packaging Systems, Inc., Atlanta, Ga.

[21] Appl. No.: 517,787

[22] Filed: May 2, 1990

[51] Int. Cl.[5] ..... B31B 1/64

[52] U.S. Cl. ..... 493/203; 493/231; 493/243; 493/936

[58] Field of Search ..... 493/128, 133, 151, 189, 493/193, 198, 203, 205, 210, 211, 212, 218, 219, 220, 224, 227, 231, 233, 243, 248, 254, 936; 383/104, 119, 121.1, 123, 124

[56] References Cited

U.S. PATENT DOCUMENTS

| | | | |
|---|---|---|---|
| 388,612 | 8/1888 | Appel | 493/231 |
| 520,951 | 6/1894 | Claussen | 493/243 |
| 2,283,069 | 5/1942 | Knuetter | 493/197 X |
| 3,136,475 | 6/1964 | Geimer . | |
| 3,319,540 | 5/1967 | Stengle, Jr. | 493/189 |
| 3,390,829 | 7/1968 | Malby et al. . | |
| 3,412,925 | 11/1968 | Booth et al. . | |
| 3,437,258 | 4/1969 | Kugler . | |
| 3,534,520 | 10/1970 | Moran . | |
| 3,534,666 | 10/1970 | Maccherone . | |
| 3,580,486 | 5/1971 | Kugler | 383/120 X |
| 3,612,133 | 10/1971 | Jarund . | |
| 3,618,478 | 11/1971 | Pizazze . | |
| 3,652,006 | 3/1972 | Trewella | 383/120 X |
| 3,715,074 | 2/1973 | Michel . | |
| 3,750,937 | 8/1973 | Goodwin . | |
| 3,764,000 | 10/1973 | Jentsch . | |
| 3,829,007 | 8/1974 | Ellison . | |
| 3,896,714 | 7/1975 | Bosse | 493/243 |
| 3,917,159 | 11/1975 | Platz et al. . | |
| 3,980,225 | 9/1976 | Kan . | |
| 4,055,109 | 10/1977 | Kan . | |
| 4,358,466 | 11/1982 | Stevenson | 493/243 X |
| 4,361,235 | 11/1982 | Gautier | 383/104 X |
| 4,453,370 | 6/1984 | Titchenal . | |
| 4,685,276 | 8/1987 | Kiel | 493/218 X |
| 4,747,703 | 5/1988 | Cazes . | |
| 4,810,109 | 3/1989 | Castel . | |
| 4,837,849 | 6/1989 | Erickson et al. . | |
| 4,848,931 | 7/1989 | Kamada et al. | 383/104 |
| 4,904,093 | 2/1990 | Woods et al. . | |
| 4,932,556 | 6/1990 | Hui et al. . | |

FOREIGN PATENT DOCUMENTS

| | | |
|---|---|---|
| 1376038 | 2/1955 | Fed. Rep. of Germany . |
| 1066855 | 10/1959 | Fed. Rep. of Germany . |
| 1903307 | 8/1970 | Fed. Rep. of Germany . |
| 0137919 | 5/1990 | Japan . |

*Primary Examiner*—Bruce M. Kisliuk
*Assistant Examiner*—John A. Marlott
*Attorney, Agent, or Firm*—Kennedy & Kennedy

[57] ABSTRACT

A container and method of making the same preferably from a single web of flexible material wherein the method comprises placing a V-fold, or modified flat V-fold, in a sheet of such material, creating two subsections whose V-fold members are attached to the respective subsections preferably along a longitudinal fold line. First and second side edge weld lines are made thereby connecting the respective subsections to their own V-fold members as well as those of the opposite subsections. Oblique weld lines then interconnect the point of intersection of the side edge weld lines and longitudinal fold line. The bottom wall is formed by folding the legs inwardly with the endmost portions of which pivoting along a lateral axis of the bottom wall upwardly towards the first and second side edge weld line thereby reinforcing the stress-bearing bottom.

30 Claims, 11 Drawing Sheets

METHOD FOR MANUFACTURING A CONTAINER

BACKGROUND OF THE INVENTION

The present invention relates to the packaging industry, and more particularly to a flexible container, as well as a method for making same.

Traditional means for packaging products, particularly liquids, have included metal cans and glass and plastic bottles. Cans and bottles have the advantage of being hermetically sealable, are of sturdy construction, and may be stored in a self-supported upright position.

However, a number of problems exist in the use of cans and bottles. For example, their production methods are complicated and expensive. The raw materials used in producing such containers are also expensive.

Furthermore, traditional cans and bottles present environmental problems in that, even in their empty state, they occupy a relatively large amount of space, whether it be at a landfill or in a kitchen garbage can. Finally, cans and bottles are rather heavy and therefore are inconvenient and expensive to transport.

In an attempt to overcome the reliance upon cans and bottles, packagers have recently begun to use flexible, fusible sheet material in forming disposable containers, such as found in U.S. Pat. No. 3,380,646 to Doyen et al. and U.S. Pat. No. 4,287,247 to Reil et al. Such containers are problematic, however, in that they have interior crevices in their bottoms and corners which may act as bacterial traps. Furthermore, they must be produced from relatively thick, and therefore expensive, retort material to be capable of standing upright without support. Even if manufactured with such thick material, the packages are typically unstable and must be supported on the shelves of a store by a box or other means. Once purchased and opened, consumers have to empty the contents of the containers into pitchers or other storage means. Also, the flexible containers used to date usually have at least one weld on their interior bottom wall, which is the location of the most pressure from liquid or other packaged products. As a result, there is a structural weakness at the bottom portions of most currently used containers.

The methods employed in producing the currently used flexible containers are complicated in that they require a relatively large number of welding steps, many of which must be performed while the container material is in a vertical orientation. As a result, the apparatus for forming the container is by necessity complicated and expensive.

There exists a need, therefore, for a container which is hermetically sealable, lightweight, and which is flexible so as not to occupy a large volume of space when emptied.

There exists a further need for a flexible container which has no interior crevices, which can be produced from relatively thin material, and which is sturdy, particularly along its bottom.

There also exists a need for a method of producing such a container which provides effective seals yet is simple, quick, and inexpensive.

SUMMARY OF THE INVENTION

The present invention relates to a container having a front wall, a rear wall, a pair of sidewalls, and a reinforced bottom wall. The bottom wall is preferably comprised of a plurality of folded leg members extending from the lower edges of the front and rear walls. The lower portions of the sidewalls are reinforced with the folded-up endmost portions of the folded leg members. The top edges of the container may be welded closed to form a hermetically sealed package.

A method of making a container from flexible material comprises placing a V-fold, or a modified flat V-fold, in a sheet of flexible material to form an intermediate structure having a first subsection, a second subsection underlying the first subsection and a V-fold section intermediate the first and lower edge of the second subsections having a first V-fold member attached to the lower edge of the first subsection and a second V-fold member attached to the lower edge of the second subsection. The first and second V-fold members are preferably connected along a longitudinal fold line.

A first side edge weld line is made connecting the upper edges with the lower edges to weld the first subsection to both the second subsection and the first V-fold member and at the same time to weld the second subsection to the second V-fold member. A second side edge weld line is made a distance from the first side edge weld line connecting the upper edges with the lower edges to weld the first subsection to both the second subsection and the first V-fold member and at the same time to weld the second subsection to the second V-fold member. The side edge welds result in the formation of an upper container portion and first and second leg portions, which are connected along the first fold line.

A first oblique weld line is made interconnecting the point of intersection of the first weld line and the first fold line to the lower edge of the first subsection. A second oblique weld line is made interconnecting the point of intersection of the second side edge weld line and the longitudinal fold line to the lower edge of the first subsection. A leg weld line maybe made between the first and second side edge weld lines at approximately the middle point of the first leg to weld the first subsection to both the first V-fold member and the second subsection the second V-fold member.

The bottom wall is formed by folding the first leg inwardly towards the first fold line so that the lower edge of the first subsection is adjacent the first fold line and folding the second leg inwardly towards the first fold line so that the lower edge of the second subsection is adjacent the longitudinal fold line. Upon separating the first subsection from the second subsection, an interior space is formed between the first and second side edge weld lines and the endmost portions of the legs pivot along the lateral axis of the bottom wall upwardly towards the first and second side edge weld lines. One of the endmost portions is attached to the first side edge weld line and the remaining endmost portion is attached to the second side edge weld line to form reinforced container side edges.

The container of the present invention has a number of significant attributes. For example, the bottom and lower side walls of the container, which are subjected to the most pressure by the contents of the container, are reinforced by multiple plys of container material, yet the container bottom is free from any debilitating internal weld. The present container may also have deeper side walls than those previously known.

Furthermore, the container can be produced from relatively thin material and therefore is lighter and less expensive to manufacture and transport than containers requiring thick material. This is especially useful when the container is made from flexible material, which is expensive. The thinness of the container walls also encourages the use of biodegradable materials, which have traditionally been thin. Still, the container is capable of standing vertically on its own, both during the filling process and when on a grocery or refrigerator shelf without the need of an outer box or other supporting means. The present invention therefore eliminates the need for transferring the contents into a pitcher or other containment means after opening. The fact that there are no crevices in the interior of the container minimizes the worry about bacteria-traps when storing the opened container between uses. This also enables the container to be used as a mixing bowl, such as for foods or other items to which water is added.

Also, once the product is used and the container is empty, the walls of the container will collapse back to its flat state. This will result in the waste container occupying far less volume in the family trash, as well as in a landfill, than the commonly used can or plastic bottle.

The method of producing the present invention is also advantageous. For example, the entire container may, in one embodiment, be produced using a single web of material. Also, the number of welds needed to be made are minimized and the entire production process prior to filling may, if desired, be performed while the web material is traveling in a horizontal plane.

Overall, the container of the present invention possesses many of the attributes of a can or bottle, but at the same time eliminates many of the negatives. Also, the method of manufacturing of the present invention is efficient and inexpensive.

DETAILED DESCRIPTION OF THE PREFERRED EMBODIMENT

Figure 1:
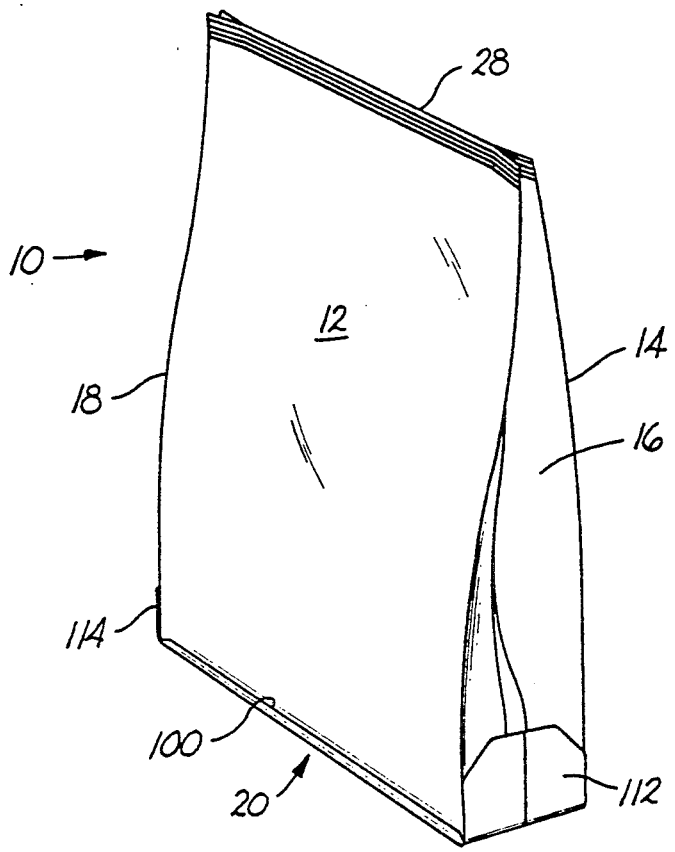
FIG. 1 is a perspective view of one embodiment of the container of the present invention.
Figure 12:
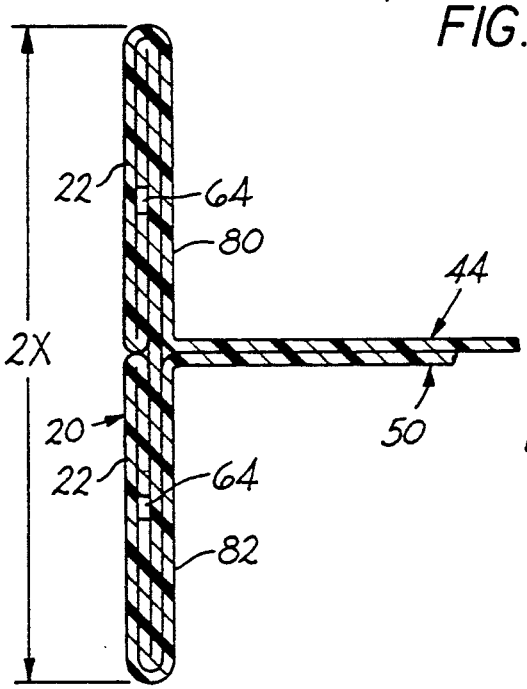
FIG. 12 is a cross-sectional view of the lower portion of the container of the present invention in its collapsed state.

FIG. 1 illustrates a flexible container 10 of the present invention. The container 10 has a front wall 12, a rear wall 14, a pair of sidewalls 16, 18, and a reinforced bottom wall 20. As illustrated in FIG. 12, the bottom wall 20 is preferably comprised of a pair of folded leg members 80, 82 extending from the lower edges of the front and rear walls 12, 14. The lower portions of the sidewalls 16, 18 are reinforced with endmost portions 112,114, which are integral with the folded leg members 80, 82. The top edge 28 of the container 10 may be welded closed to form a hermetically sealed package. Leg weld line 100*a* is located at the intersection of the front wall 12 and the bottom wall 20, and leg weld line 100*b* is located at the intersection of the rear wall 14 and the bottom wall 20, both for further maintaining the container 10 in upright position. The weld lines 100*a,b* also reinforce the intersection of the front wall 12 and the bottom wall 20 and prevent flex-cracking of container material, particularly aluminum foil type material.

Figure 2:
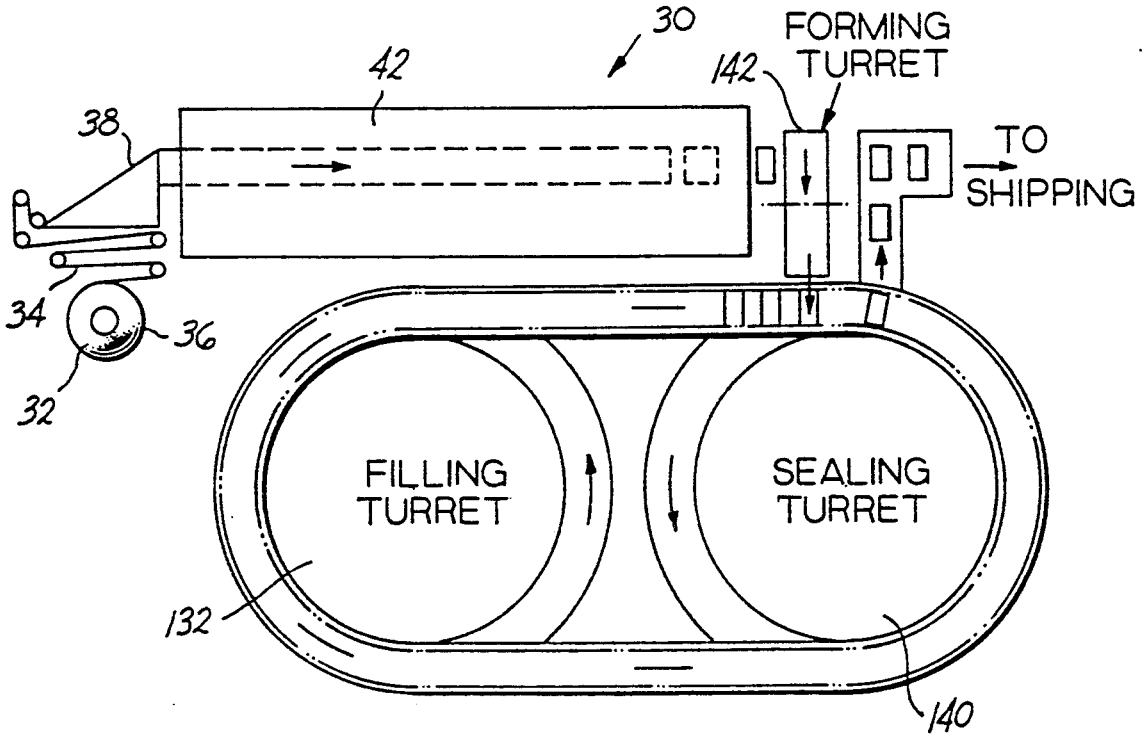
FIG. 2 is a schematic of an apparatus for manufacturing the container of the present invention.

FIG. 2 illustrates an apparatus 30 which may be used to manufacture the container 10 of the present invention. A single web 32 of container material 34 is delivered from a roller 36 to a standard V-plow 38. The V-plow 38 creates a V-fold in the approximate center of the material 34, such as shown in FIG. 3, and the material 34 is passed through the remaining processes along a conveyor belt 42, preferably in a horizontal orientation.

Figure 3:
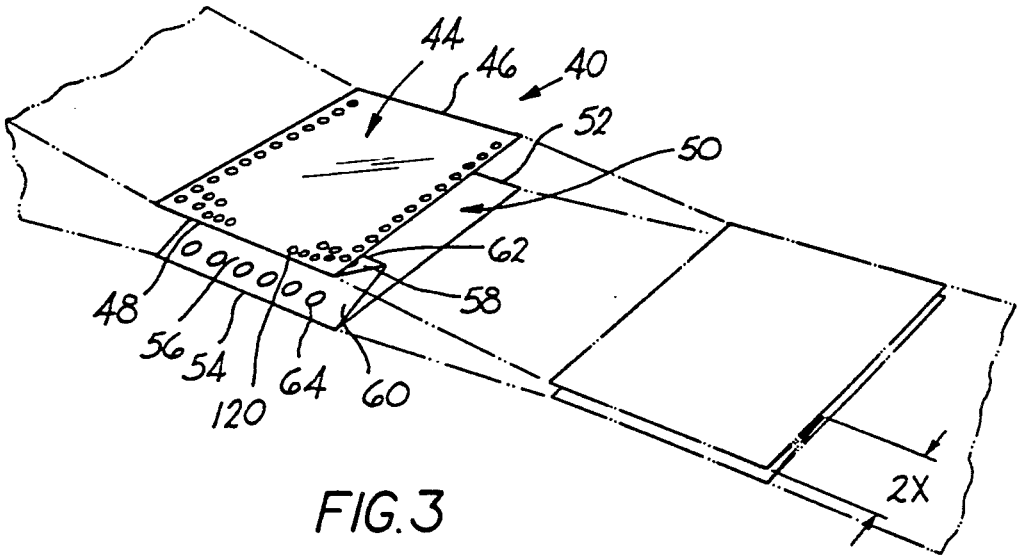
FIG. 3 is a perspective view of one embodiment of the intermediate structure of the container of the present invention.

As shown in FIG. 3, an intermediate structure 40 has a first subsection 44 having an upper edge 46 and a lower edge 48, a second subsection 50 underlying the first subsection 44 and having an upper edge 52 and a lower edge 54, and a V-fold section 56 intermediate the first subsection 44 and the second subsection 50. The V-fold section 56 includes a first V-fold member 58 attached to the lower edge 48 of the first subsection 44 and a second V-fold member 60 attached to the lower edge 54 of the second subsection 50. The top edge of the first V-fold member 58 is connected to the top edge of the second V-fold member 60 along a common point such as first fold line 62. The length of the member 58, 60 may be identical or different. For example, the length of each of the V-fold members 58, 60 in the present embodiment is 2×. The intermediate structure 40 is capable of being collapsed into a relatively flat, multiple-plied structure, so that a single weld made on the first subsection may produce weld lines on both the first and second subsection 44, 50.

Figure 4:
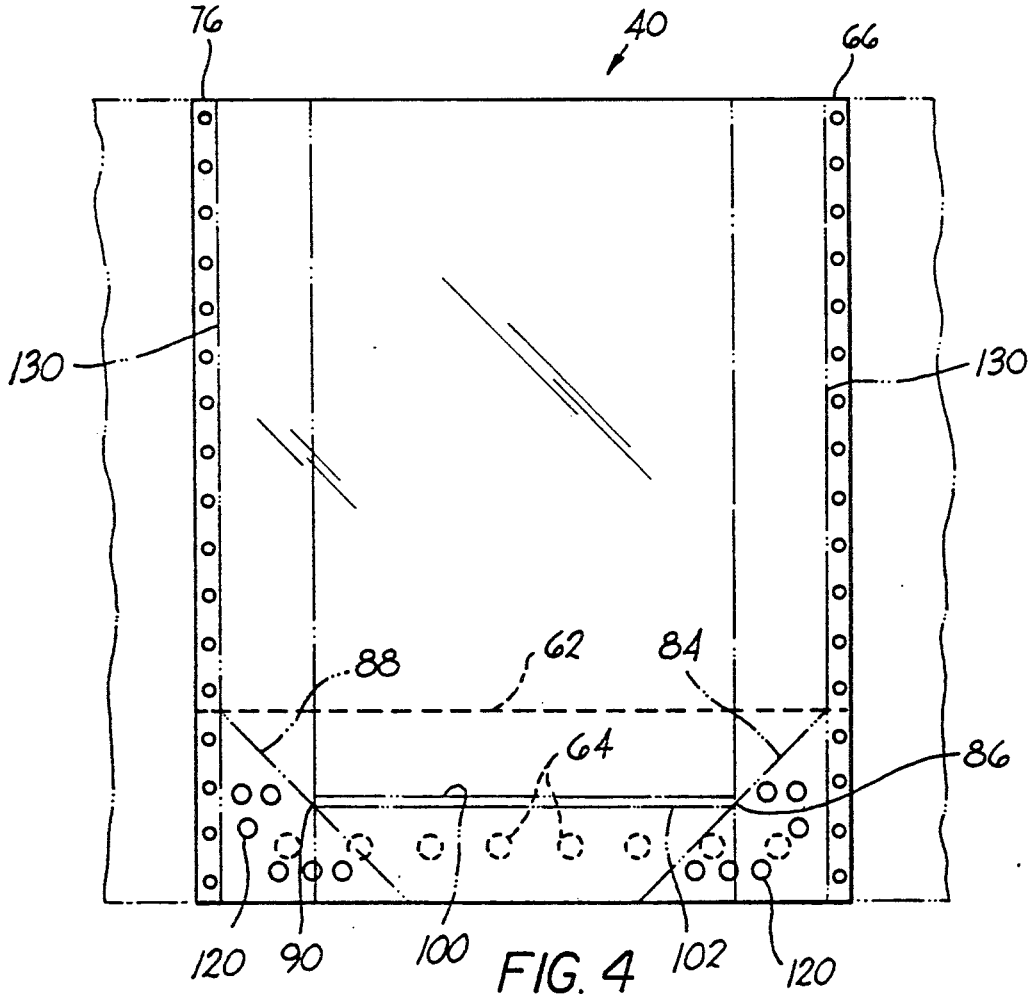
FIG. 4 is a top view of one embodiment of the intermediate structure of the container of the present invention.

The container 10 is preferably comprised of a two-ply laminated material, such as a coextruded solid sheet of low density/high density polyethylene or a laminated multilayered sheet. Typically this material will have an inner ply which is plastic, and hence heat-sealable, and an outer ply which is not. In the steps of manufacturing the container 10, it is sometimes necessary to attach one surface of the intermediate structure 40 to another. This attachment may be accomplished with adhesives, or may alternatively be accomplished by other means of attaching one surface to another, such as standard cold or heat-sealing. To the extent that heat sealing is used, it may be necessary to expose the heat-sealable inner ply by removing the outer-ply at a point of attachment. For example, weld spots 64, 120 and 130 are shown in FIG. 3 and 4 at positions which will eventually be attachment points for forming the container 10. Also, the term weld used herein is defined as any means of attaching one surface to another.

Figure 5:
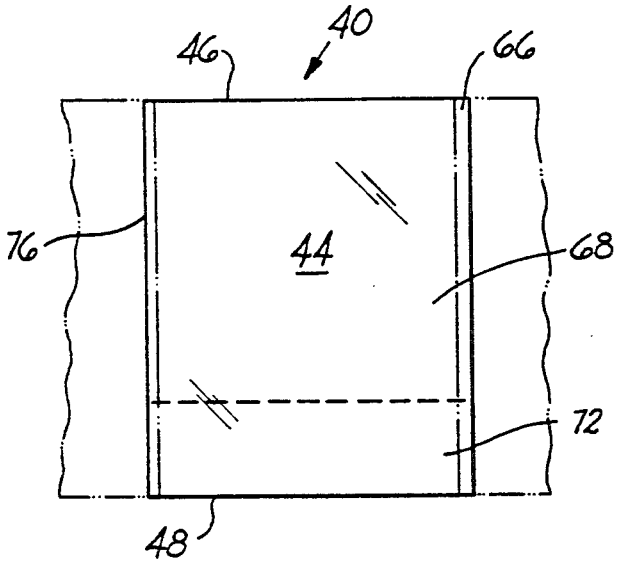
FIG. 5 is a top view of one embodiment of the intermediate structure of the container of the present invention illustrating the preferred position of the side edge weld lines.
Figure 6:
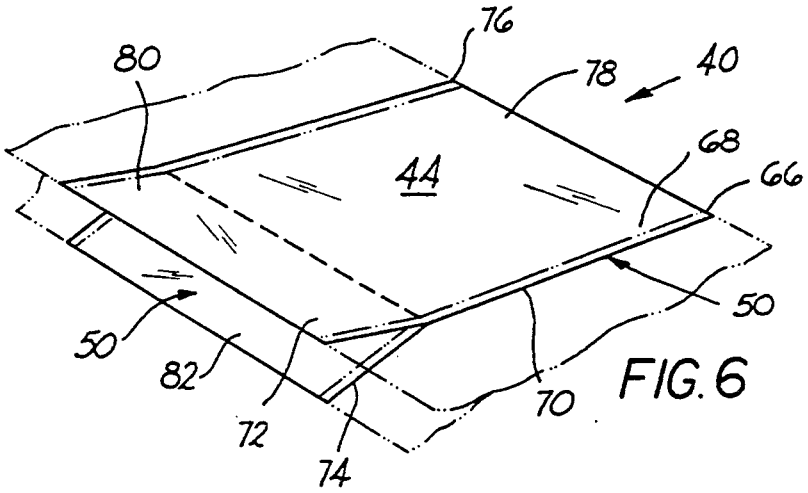
FIG. 6 is a perspective view of the intermediate structure of FIG. 5 illustrating separated legs.

As shown in FIGS. 5 and 6, once the V-fold section 56 is formed, a first side edge weld line 66 is placed made connecting the juxtaposed upper edges 46, 52 and lower edges 48, 54. The line 66 should be relatively thick, for example about one-half inch thick, so that it may be later cut in half while maintaining its seal. The result of the first side edge weld line 66 will be the attachment of the upper portion 68 of the first subsection 44 to the upper portion 70 of the second subsection 50, the lower portion 72 of the first subsection 44 to the first V-fold member 58 and the lower portion 74 of the second subsection 50 to the second V-fold member 60. Similarly, a second side edge weld line 76 is made at a distance away from the first side edge weld line 66. The result of the second weld line 76 will also be and connecting upper edges 48, 54 and lower edges 48, 52 the attachment of the upper portion 68 of the first subsection 44 to the upper portion 70 of the second subsection 50, the lower portion 72 of the first subsection 44 to the first V-fold member 58 and the lower portion 74 of the second subsection 50 to the second V-fold member 60. The first and second side edge welds 66, 76 will thereby form an upper container portion 78, a first leg portion 80 and a second leg portion 82, as shown in FIG. 6.

Figure 7:
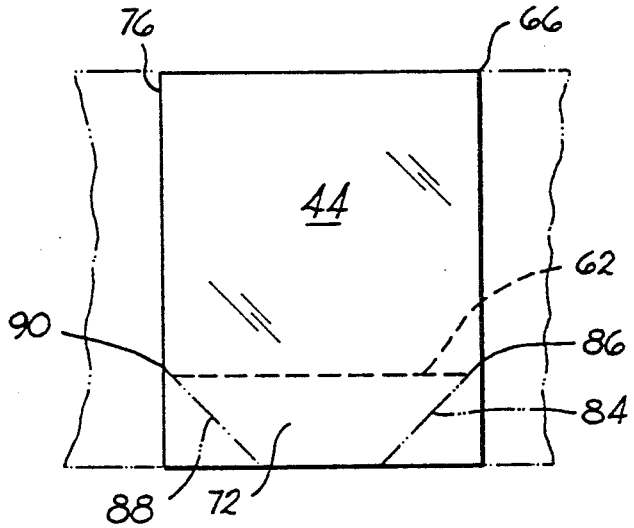
FIG. 7 is a top view of the intermediate structure of FIG. 4 illustrating the preferred position of the oblique weld lines.
Figure 8:
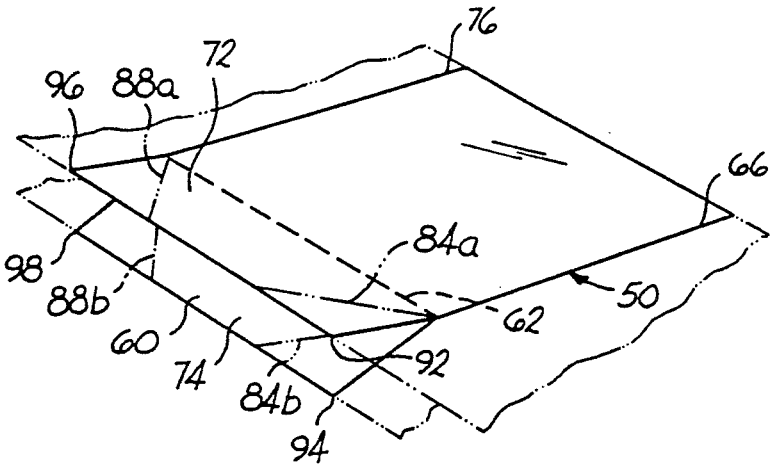
FIG. 8 is a perspective view of the intermediate structure of FIG. 7 illustrating separated legs.

As shown in FIGS. 7 and 8, in the present embodiment, a first oblique weld line 84 is placed interconnecting the common point 86 of intersection of the first side edge weld line 66 and the top edges of the V-fold members 58, 60, when the subsections 44, 50 are in underlying position, to the lower edge 48 of the first subsection 44. When the V-fold members 58, 60 are attached along the first fold line 62, the common point 86 will also be the intersection of the first fold line 62 and weld line 66. The first oblique weld line 84 results in the attachment of the lower portion 72 of the first subsection 44 to the first V-fold member 58 along line 84*a* and the lower portion 74 of the second subsection 50 to the second V-fold member 60 along line 84*b*. Similarly, a second oblique weld line 88 is placed interconnecting the point 90 of intersection of the second side edge weld line 76 and top edges 59, 61 and the lower edge 48. The second oblique weld line 88 results in the attachment of the lower portion 72 of the first subsection 44 to the first V-fold member 58 along line 88*a* and the lower portion 74 of the second subsection 50 to the second V-fold member 60 along line 88*b*. Both the first and second oblique weld lines 86, 88 should be at approximately 45° angles. Additionally, the entire area between the first oblique weld lines 84*a,b* and corners 92, 94, as well as between the second oblique weld lines 88*a,b* and corners 96, 98, may be welded together.

Figure 28:
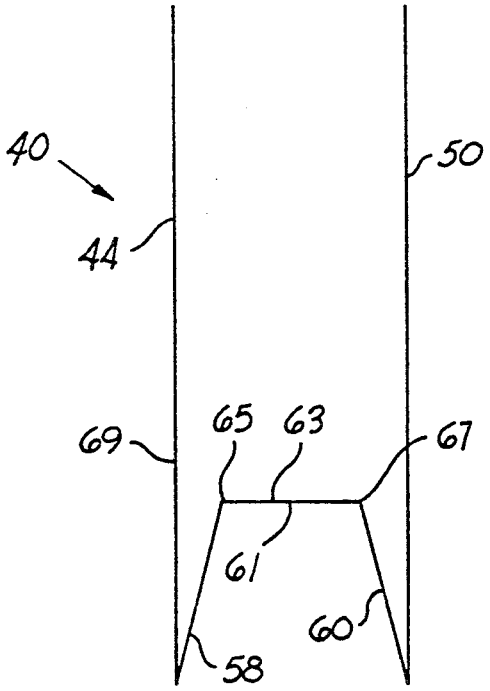
FIG. 28 is a cross-sectional view of an intermediate structure having a middle member in its V-fold section.

In an alternate embodiment of the present invention, as shown in FIG. 28, the V-fold section 56 may include a middle member 63 attached at a first end 65 to the first V-fold member 58 and at a second end 67 to the second V-fold member 60. This will eliminate the need for the first fold line 62, which may be undesirable when the container material 34 is aluminum or some other material which may be subject to flex-cracking upon folding. In this embodiment, the first oblique weld line 84 is begun at the common point 69, which corresponds to the intersection of the first side edge weld line 66 and the top edges of the V-fold members 58, 60 plus one-half the width of the middle member 63. For example, as seen in FIG. 28, if the width of the middle member 63 is 2×, as measured between first end 65 and second end 67, the common point 69 will be located a distance of 1× above the intersection of the V-fold members 58, 60 and the first side edge weld line 66. The first oblique weld line 84 will extend between the common point 69 and the lower edge 48 of the first subsection 44 at an approximately 45° angle. Similarly, the second oblique weld line 88 is provided between a common point 69, as defined above, along second side edge weld line 88 and the lower edge 48 of the first subsection 44. The remaining steps in the formation of the container 10 may be as set forth above.

Figure 9:
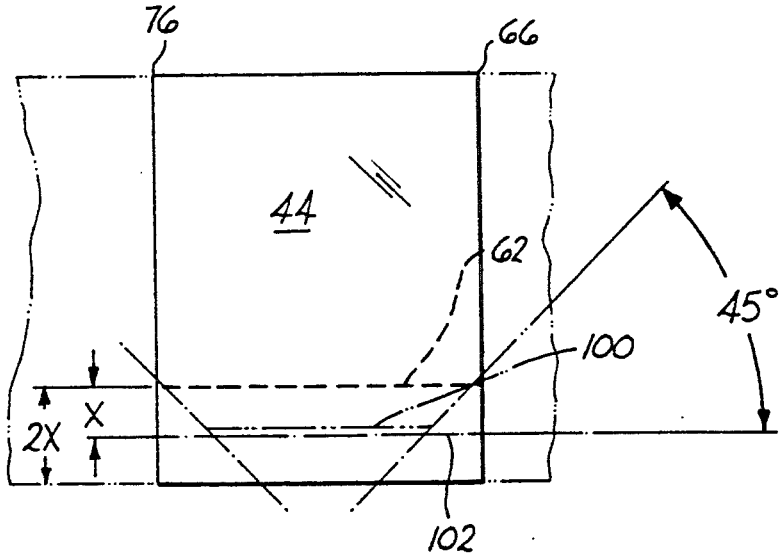
FIG. 9 is a top view of the intermediate structure illustrating the preferred position of the leg weld line.
Figure 10:
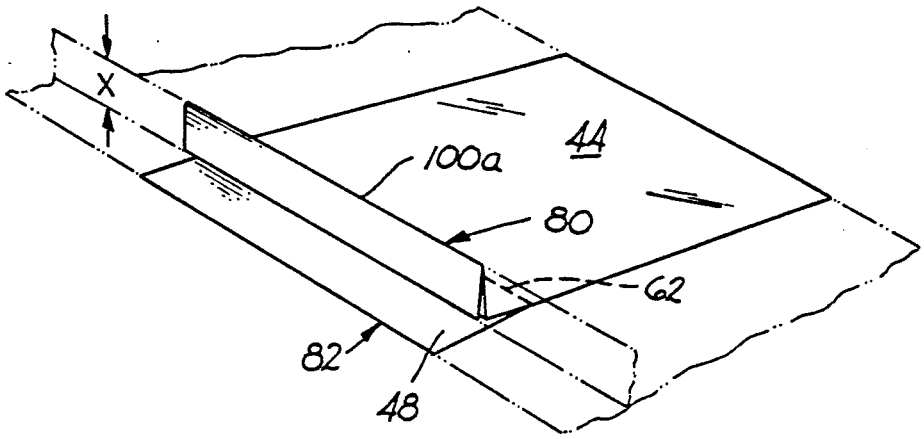
FIG. 10 is a perspective view of the intermediate structure having one leg folded.
Figure 11:
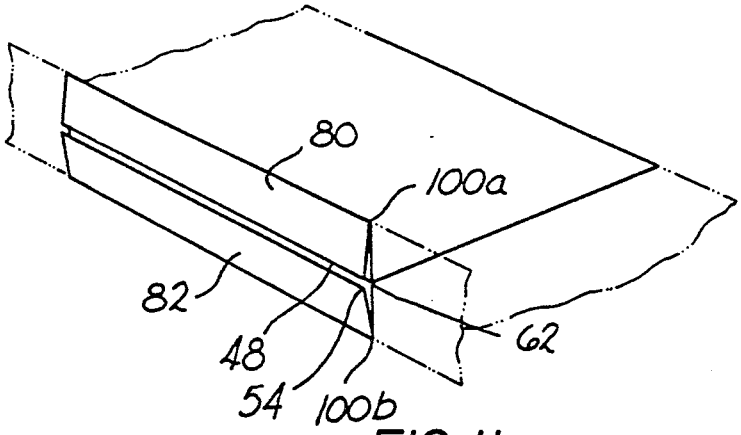
FIG. 11 is a perspective view of the intermediate structure having both legs folded.
Figure 13:
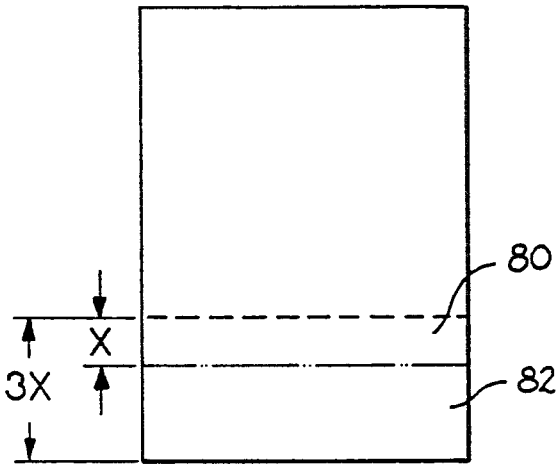
FIG. 13 is a top view of an intermediate structure wherein one leg is longer than the other.
Figure 14:
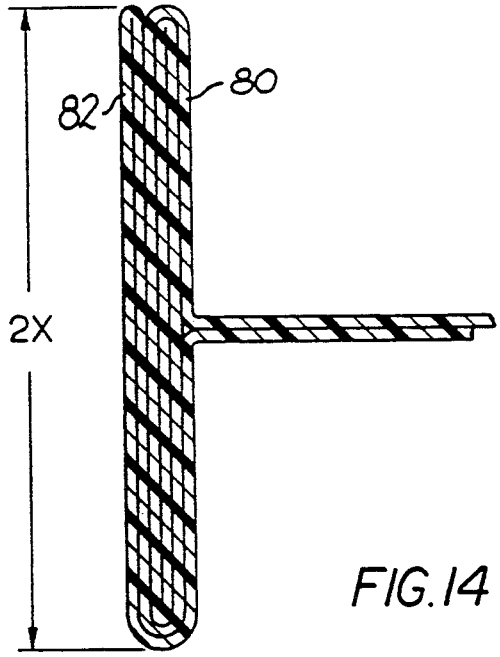
FIG. 14 is a cross-sectional view of the lower portion of the intermediate structure having legs of different sizes in folded position.
Figure 15:
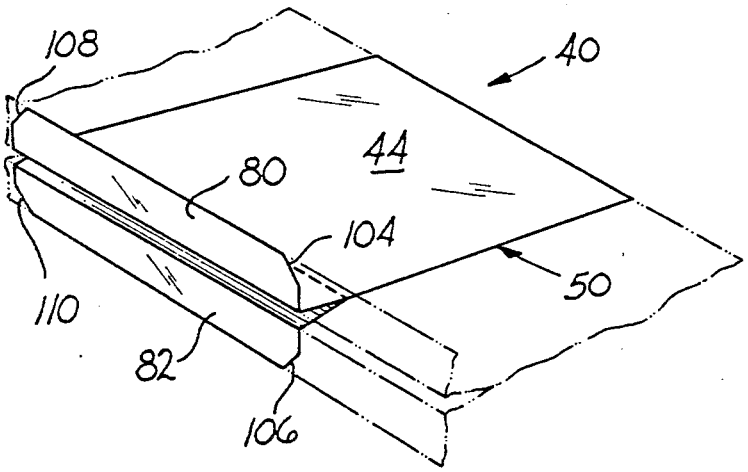
FIG. 15 is a perspective view of one embodiment of the intermediate structure having the corner portions of the legs removed.

As shown in FIG. 9, a leg weld line 100 may be made between the first side edge weld line 66 and the second side edge weld line 76 at approximately the middle line 102 of one of the legs 80, 82, resulting in weld line 100*a* on the first leg 80 and line 100*b* on the second leg. It is preferred that the line 100 be made slightly (i.e. one sixteenth of an inch) above the midline 102 of the legs 80, 82. As shown in FIG. 10, the first leg 80 is folded along the first weld line 100*a* so that the lower edge 48 of the first subsection 44 is adjacent the first fold line 62. Similarly, as shown in FIG. 11, the second leg 82 is folded along the leg weld line 100*b* so that the lower edge 54 of the second subsection 50 is adjacent the first fold line 62 and the lower edge 48 of the first subsection 44. As shown in FIG. 12, the legs 80, 82 may be maintained in folded position by adhesives or by spot-welding, such as at weld-spots 64, thereby forming bottom wall 20. In the present embodiment, the width of each leg 80, 82 will be 1×. However, as shown in FIGS. 13 and 14, the length of one leg, for example leg 82, may be greater than the length of the remaining leg 80. In such a case, the longer leg 82 is folded a plurality of times, such as illustrated in FIG. 14. Also, the legs 80, 82 may be shortened so as not to be adjacent the first fold line 62, but rather to be merely adjacent leg weld lines 100*a,b*. For example the portion of the legs 80, 82 below the leg weld lines 100*a,b* may be eliminated to provide a container 10 having a single-ply bottom 20. Also as shown in FIG. 15, the corners 104, 106, 108 110 of the folded legs 80, 82 may be removed, such as by die cutting, for aesthetic reasons. It should be noted that even at this stage of manufacturing the structure 40 can be collapsed flat so that the first subsection 44 maybe overlying the second subsection 50.

The structure 40 may be divided into individual containers 10 by cutting along the approximate midlines of the first side edge weld line 66 and the second side edge weld line 76. It is advisable that the first and second side edge weld lines 66, 76 be of sufficient width to provide an adequate seal between the first and second subsections 44, 50 after cutting. This will allow the formation of two sealed container 10 edges by a single cut.

Figure 16:
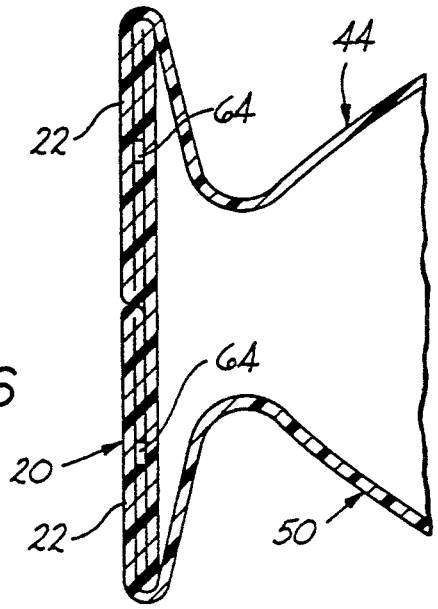
FIG. 16 is a cross-sectional view of the container of the present invention in partially opened condition.
Figure 17:
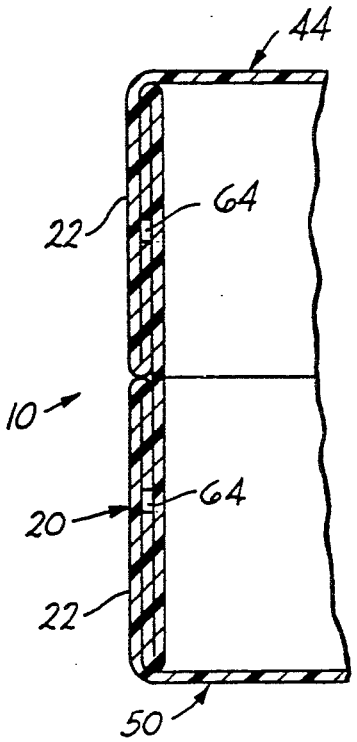
FIG. 17 is a cross-sectional view of the container of the present invention in fully opened condition.

Referring to FIGS. 12, 16 and 17, the interior space of the container 10 is provided by separating the first subsection 44 from the second subsection 50. As can be seen in FIG. 17, when the subsections 44, 50 are fully separated, the lower portion of the container 10 acquires a squared-off shape, and the bottom wall 20 will be seamless. The container 10 may be opened by a forming turret 142, such as shown in FIG. 2.

Figure 18:
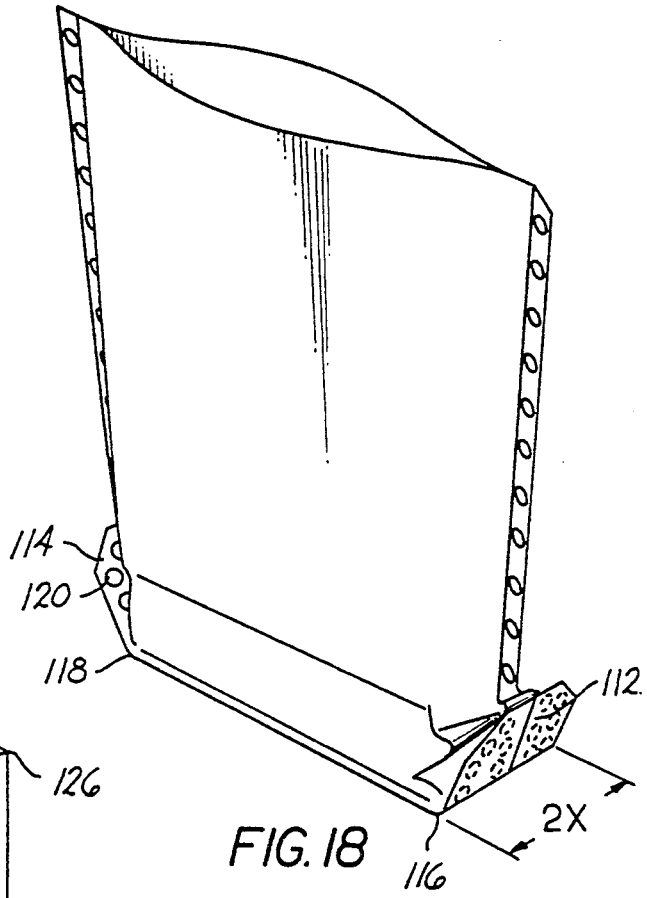
FIG. 18 is a perspective view of one embodiment of the container of the present invention having partially separated subsections.
Figure 19:
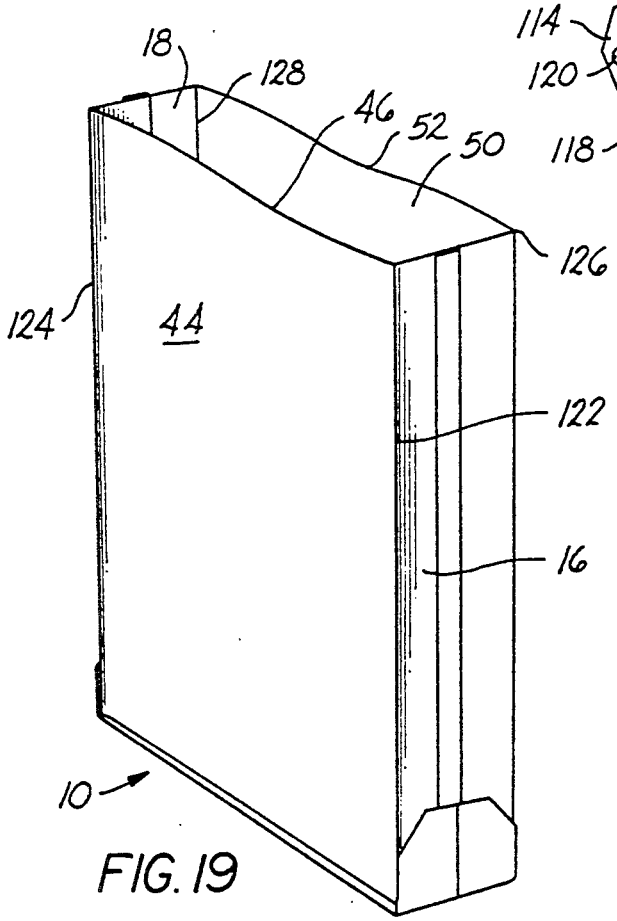
FIG. 19 is a perspective view of one embodiment of the container of the present invention having fully separated subsections.
Figure 27:
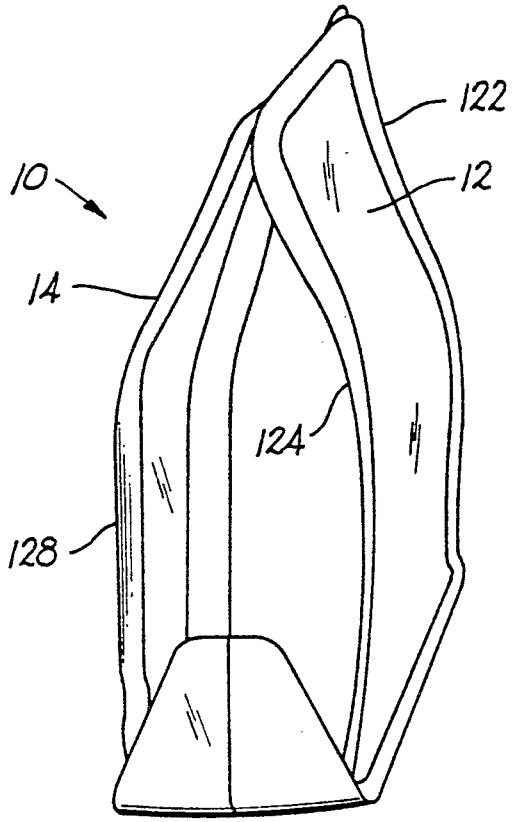
FIG. 27 is a perspective view of one embodiment of the container of the present invention having reinforced side edges.

Referring to FIG. 18, upon separation of the first subsection 44 and the second subsection 50, a first endmost portion 112 of the folded legs 80, 82 pivots upwardly along the lateral axis of the bottom wall 20 towards the first side edge weld line 66, preferably along the point 116 where the leg weld line 100 intersects the first oblique weld lines 84*a,b*. Similarly, a second endmost portion 114 of the legs 80, 82 pivots upwardly towards the second side edge weld line 76, preferably along the point 118 where the leg weld line 100 intersects the second oblique weld lines 88*a,b*. Weld-spots 120 may be provided for attaching the endmost portions 112, 114 to the side edges of the container 10, such as to the first subsection 44 and the second subsection 50. Also, as shown in FIG. 19, foldlines 122, 124 may be provided in the first subsection 44 between points 116, 118 and the upper edge 46, and foldlines 126, 128 may be provided in the second subsection 50 between points 116, 118 and the upper edge 52, for providing the container 10 with clearly defined squared-off side edges 16, 18, which will be like side walls. However, in some embodiments the side walls may not be clearly defined. The first side edge weld line 66 and the second side edge weld line 76 may be attached to the first subsection 44, such as by pinching or by weld-spots 130, to further reinforce the sidewalls 16, 18. Of course, the side edge weld lines 66, 76 may alternatively be folded in an opposite direction and attached to the second subsection 50. Also, as shown in FIG. 27, the frontwall 12 and rearwall 14 may be attached to the side edges 16, 18 along side edge foldlines 122, 124, 126, 128 to further stabilize the container 10.

Figure 20:
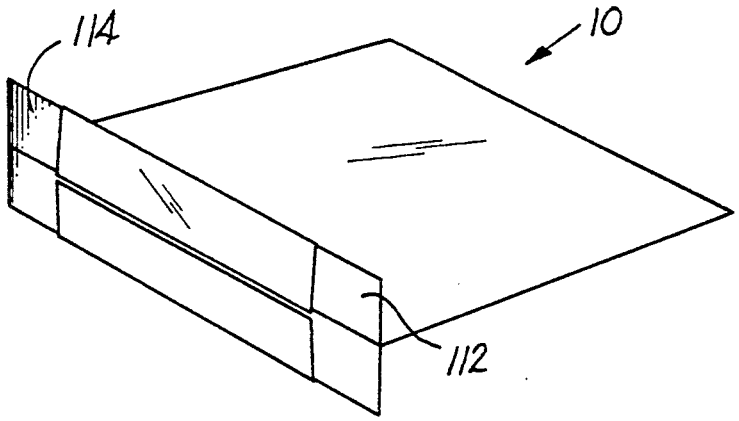
FIG. 20 is a perspective view of the intermediate structure having both legs folded and having one ply of the endmost portions of the leg removed.

Referring to FIG. 20, it may be desirable to remove one of the plys from each of the endmost portions 112, 114, such as for aesthetic reasons in instances where less reinforcement is needed at the container side walls 16, 18.

Figure 21:
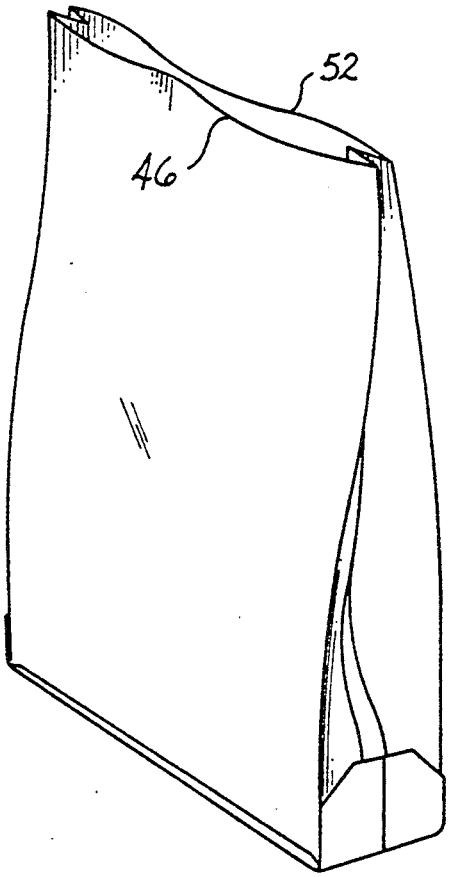
FIG. 21 is a perspective view of one embodiment of the container of the present invention having its sidewalls folded inwardly.
Figure 22:
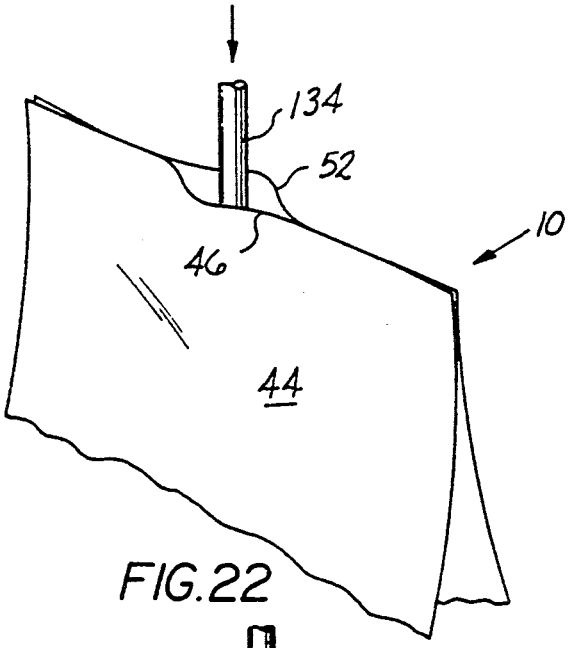
FIG. 22 is a perspective view of one embodiment of the container of the present invention having a filling nozzle inserted between its subsections.
Figure 23:
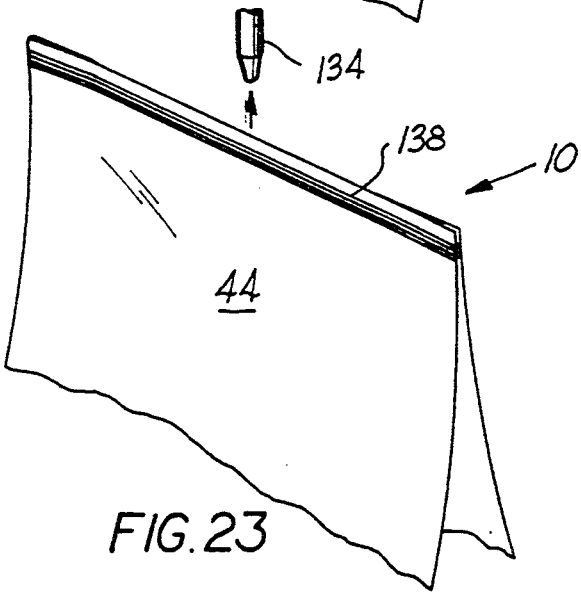
FIG. 23 is a perspective view of one embodiment of the container of the present invention having sealed top edges.
Figure 24:
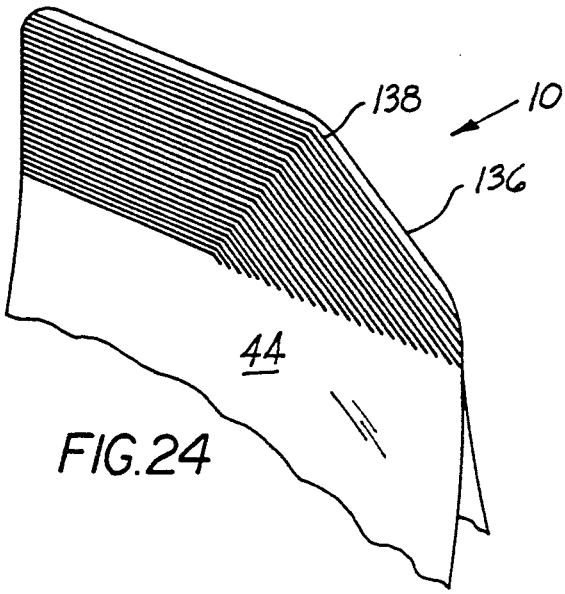
FIG. 24 is a perspective view of one embodiment of the container of the present invention having thickly sealed top edges.

Once the sidewalls 16, 18 are formed, the container 10 may be filled and sealed. This procedure may be performed on a standard filling turret 132, such as shown in FIG. 2. As shown in FIG. 21, 22 and 23, a standard filling nozzle 134 may be used to place product into the container 10. Because of it's unique construction, the container 10 may be self-standing during the filling process. Once- the container 10 is full, the nozzle 134 may be removed and the upper edge 46 of the first subsection 44 may be welded or otherwise sealed to the upper edge 52 of the second subsection 50, such as by a top weld line 138. The sealing of the container 10 top may be performed with the container 10 in self-standing upright position on a standard sealing turret 140. As shown in FIG. 24, the top weld line 138 may be made thick and with one corner 136 squared-off to provide an easy pouring spout for the container 10. A handle may be provided in it.

Figure 26:
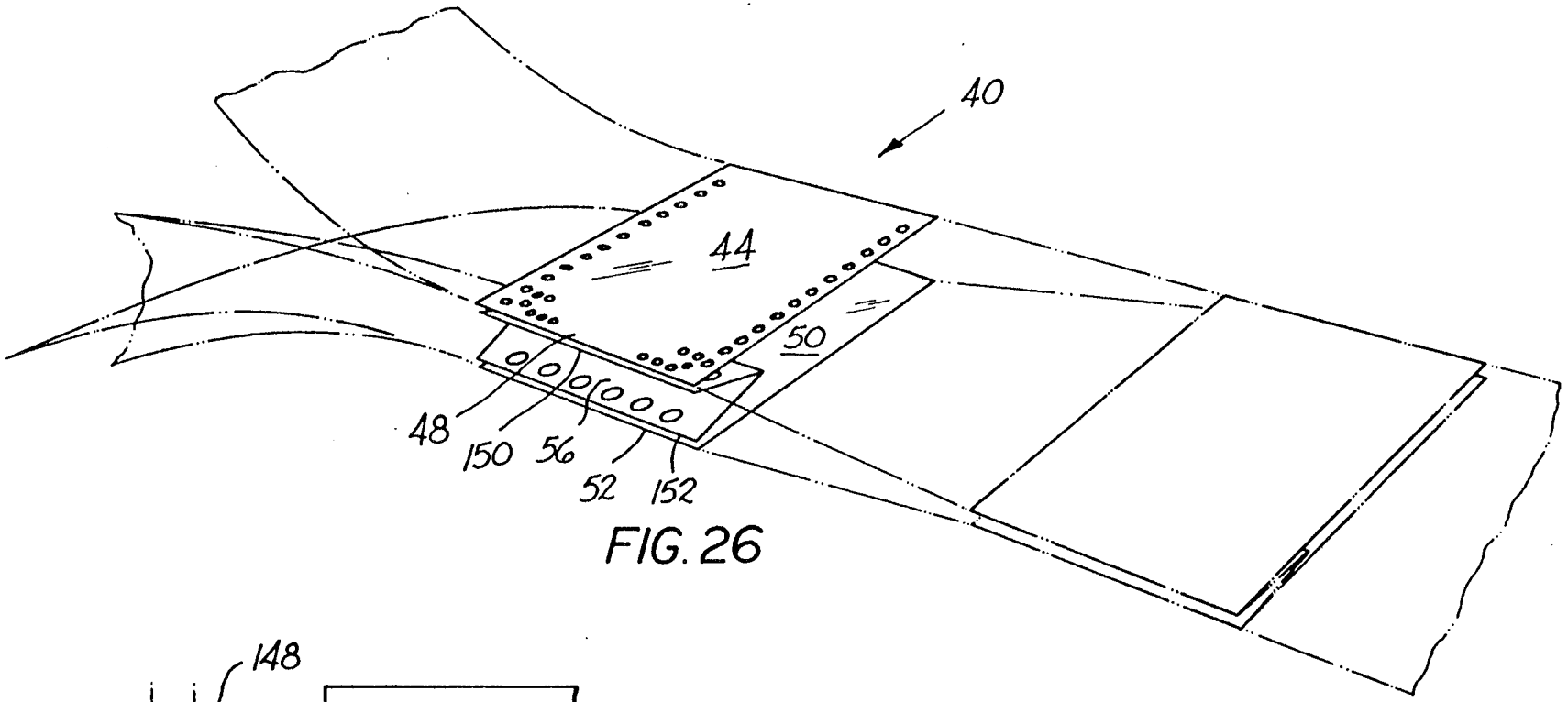
FIG. 26 is a perspective view of an intermediate structure manufactured using multiple webs of material.
Figure 25:
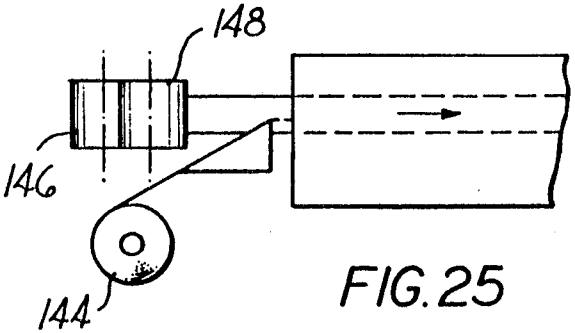
FIG. 25 is a schematic of an apparatus for manufacturing the container of the present invention from multiple webs of material.

It is also possible to manufacture the container 10 of the present invention using multiple webs. For example, as shown in FIGS. 25 and 26, the first subsection 44, the second subsection 50 and the V-fold section 56 may each be provided from separate webs 144, 146, 148 and welded or otherwise attached to form the intermediate structure 40. In such a case, the lower edge 48 of the first subsection 44 will be attached to a first edge 150 of the V-fold section 56 and the lower edge 52 of the second subsection 50 will be attached to a second edge 152 of the V-fold section 56. Once the intermediate structure 40 is formed, the remaining steps of the manufacturing process may be as set forth above or the equivalent.

While this invention has been described in detail with particular reference to the preferred embodiment thereof, it will be understood that variations and modifications can be effected within the spirit and scope of the invention as previously described and as defined in the claims. For example, the sequence of the steps set forth herein may be altered, and welds may be accomplished by lines of adhesive or other attachment means. As an alternative to the method of mass producing containers 10 set forth above, each individual container 10 may, using the method of the present invention, be produced from a single sheet of material rather than from a continuous web. Therefore, while the above description contains many specificities, these should not be construed as limitations on the scope of the invention, but rather as an amplification of one preferred embodiment thereof.

What is claimed is:

1. A method of making a container from material, comprising:

forming the material into an intermediate structure having a first subsection having an upper edge and a lower edge, a second subsection underlying the first subsection and having an upper edge and a lower edge, and a V-fold section intermediate the first and second subsections having a first V-fold member attached to the lower edge of the first subsection and a second V-fold member attached to the lower edge of the second subsection, the top edge of the first V-fold member connected to the top edge of the second V-fold member at a connection point;

placing on the intermediate structure a first side edge weld line connecting the upper edges with the lower edges to weld the first subsection to the second subsection and to the first V-fold member and to weld the second subsection to the second V-fold member;

placing on the intermediate structure a second side edge weld line connecting the upper edges with the lower edges, the second side edge weld line being a distance from the first side edge weld line to weld the first subsection to the second subsection and to the first V-fold member and to weld the second subsection to the second V-fold member, thereby forming first and second legs;

placing on the intermediate structure first and second legs a first oblique weld line interconnecting the first side edge weld line and the lower edge of the first subsections to weld the first subsection to the first V-fold member and the second subsection to the second V-fold member thereby forming endmost portions of said legs bounded by said first side edge weld, said lower edges and said first oblique weld line, placing on the intermediate structure first and second legs a second oblique weld line interconnecting the second side edge weld line and the lower edge of the first and second subsections to weld the first subsection to the first V-fold member and the second subsection to the second V-fold member thereby forming other endmost portions of said legs bounded by said second side edge weld, and said lower edges and said second oblique weld line;

folding the first and second legs inwardly towards the connection point; and separating the first subsection from the second subsection to form an interior space between the first and second side edge weld lines and to cause the endmost portions of the legs to pivot upwardly towards the first side edge weld line and the second side edge weld line respectively to form said container having a front wall, a rear wall and a pair of opposing side edges interconnecting the front wall and rear wall.

2. The method of claim 1, and further comprising the step of maintaining the legs in folded position.

3. The method of claim 1, and further comprising the step of attaching the endmost portions of the legs to the side edges.

4. The method of claim 1, and further comprising the step of placing a leg weld line between the first and second side edge weld lines to weld the first subsection to the first V-fold member and the second subsection to the second V-fold member.

5. The method of claim 4, and further comprising the step of removing the portions of the legs extending from the leg weld line to the lower edges of the first and second subsections.

6. The method of claim 4, and further comprising the step of folding the first and second legs along the leg weld line inwardly towards the connection point after placing the first and second oblique weld lines.

7. The method of claim 4, wherein the legs are approximately the same size and wherein the leg fold line is provided slightly above the mid-points of the legs.

8. The method of claim 1, wherein the first and second oblique weld line are placed at approximately 45 degree angles with respect to said side edge weld lines and to said lower edges.

9. The method of claim 1, wherein the top edge of the first V-fold member is connected to the top edge of the second V-fold member along a first fold line.

10. The method of claim 9, wherein the first oblique weld line interconnects the point of intersection of the first side edge weld line and the first fold line with the lower edge of the first subsection and the second oblique weld line interconnects the point of intersection of the second side edge weld line and the first fold line with the lower edge of the first subsection.

11. The method of claim 1, wherein the V-fold section further comprises a middle member attached at a first end to the top edge of the first V-fold member and at a second end to the top edge of the second V-fold member.

12. The method of claim 11, wherein the first oblique weld line interconnects the point which corresponds to the intersection of the first side edge weld line and the top edge of the first V-fold member plus one-half the distance between the first and second ends of the middle member with the lower edge of the first subsection and the second oblique weld line interconnects the point which corresponds to the intersection of the second side edge weld line and the top edge of the second V-fold member plus one-half distance between the first and second ends of the middle member with the lower edge of the first subsection.

13. The method of claim 1, whereon one of the legs is longer than the other and further comprising the step of folding the longer leg a plurality of times along a fold line extending substantially parallel to the lower edge to provide a bottom wall reinforced by multiple folds.

14. The method of claim 1, and further comprising the step of placing a top seal between the first and second side edge weld lines to seal the container.

15. The method of claim 14, and further comprising the step of placing the container on a sealing turret in free-standing upright position and sealing the container.

16. The method of claim 1, wherein a single sheet of material is formed into said intermediate structure.

17. The method of claim 1, wherein a continuous web of material is formed into said intermediate structure.

18. The method of claim 1 wherein a plurality of sheets of material is formed into said intermediate structure.

19. The method of claim 1 wherein a plurality of continuous webs of material is formed into said intermediate structure.

20. The method of claim 1, wherein the first subsection is produced from a first continuous web of material, the second subsection is produced from a second continuous web of material and the V-fold section is produced from a third continuous web of material, and further comprising the step of attaching the lower edge of the first subsection to the lower edge of the first V-fold member and the lower edge of the second subsection to the lower edge of the second V-fold member.

21. The method of claim 1 in combination with the method of filling a container made by the method of claim 1, and wherein the filling method comprises the step of placing said container on a filling turret in free-standing upright position and filling the container.

22. The method of claim 1, wherein said first V-fold member and said second V-fold member are of approximately identical length.

23. The method of claim 1, and further comprising the step of pinching in the fold lines to create reinforced side edges.

24. The method of claim 1, and further comprising placing another weld line between the first and second side edge weld lines at approximately the middle point of the first leg to weld the first subsection to the first V-fold member and the second subsection to the second V-fold member, and folding said legs along said another weld line.

25. A method of making a container from flexible material comprising:

placing a V-fold in a sheet of flexible material to form an intermediate structure having a first subsection having an upper edge and a lower edge, a second subsection underlying the first subsection and having an upper edge and a lower edge, and V-fold section intermediate the first and second subsections having a first V-fold member attached to the lower edge of the first subsection and a second V-fold member attached to the lower edge of the second subsection, the first and second V-fold members connected along a first fold line;

placing on the intermediate structure a first side edge weld line connecting the upper edges with said lower edges to weld the first subsection to the second subsection and to the first V-fold member and to weld the second subsection to the second V-fold member;

placing on the intermediate structure a second side edge weld line connecting the upper edges with said lower edges, the second side edge being a distance from the first side edge weld line to weld the first subsection to the second subsection and to the first V-fold member and to weld the second subsection to the second V-fold member, thereby forming first and second legs which are connected along the first fold line;

forming a first oblique weld line interconnecting the point of intersection of the first side edge weld line and the first fold line with the lower edge of the first subsection to weld the first subsection to the first V-fold member and the second subsection to the second V-fold member, thereby forming endmost portions of said legs bounded by said first side edge weld, said lower edges and said first oblique weld line;

forming a second oblique weld line interconnecting the point of intersection of the second side edge weld line and the first fold line with the lower edge of the first subsection to weld the first subsection to the first V-fold member and the second subsection to the second V-fold member, thereby forming other endmost portions of said legs bounded by said second side edge weld, and said lower edges and said second oblique weld line;

folding the first leg inwardly towards the first fold line;

folding the second leg inwardly towards the first fold line;

separating the first subsection from the second subsection to form an interior space between the first and second side edge weld lines and to cause the endmost portions of the legs to pivot upwardly towards the first side edge weld line and the second side edge weld line respectively to form said container having a frontwall, a rearwall and a pair of opposing side edges interconnecting the frontwall and the rearwall; and attaching the endmost portions to the side edges.

26. The method of claim 25, further comprising the step of placing a top seal between the first and second side edge weld lines to seal said container.

27. The method of claim 25, wherein said first V-fold member and said second V-fold member are of different lengths and one of said legs is folded a plurality of times.

28. A method of making a container from material comprising the steps of:

forming the material into an intermediate structure having a first subsection having an upper edge and a lower edge, a second subsection underlying the first subsection and having an upper edge and a lower edge, and a folded section intermediate the first and second subsections having a first fold attached to the lower edge of the first subsection, a second fold attached to the lower edge of the second subsection and a middle fold extending between and joined to the first and second folds along fold lines, welding the side edges of the intermediate structure together along first and second side edge weld lines thereby welding the first and second subsections together to form first and second legs, placing on the intermediate structure first and second legs a first oblique weld line interconnecting the first side edge weld line and the lower edge of the first and second subsections to weld the first subsection to the first fold and the second subsection to the second fold thereby forming endmost portions of said legs bounded by said first side edge weld, said lower edges and said first oblique weld line;

placing on the intermediate structure first and second legs a second oblique weld line interconnecting the second side edge weld line and the lower edge of the first and second subsections to weld the first subsection to the first fold and the second subsection to the second fold thereby forming other endmost portions of said legs bounded by said second side edge weld, and said lower edges and said second oblique weld line;

folding the first and second legs inwardly; and separating the first subsection from the second subsection to form an interior space between the first and second side edge weld lines so as to cause the endmost portions of the legs to pivot upwardly towards the first side edge weld line and the second side edge weld line respectively to form said container having a front wall, a rear wall and a pair of opposing side edges interconnecting the front wall and rear wall.

29. The method of claim 28 wherein forming the material into the intermediate structure the middle fold is formed extending at oblique angles from the first second folds.

30. The method of claim 28 further comprising the step of folding the first and second legs inwardly after placing the first and second oblique weld lines.

* * * * *